US010669721B2

(12) United States Patent
Baltz, Jr. et al.

(10) Patent No.: US 10,669,721 B2
(45) Date of Patent: Jun. 2, 2020

(54) FLASHING DEVICE ASSEMBLY

(71) Applicants: Gary George Baltz, Jr., Mountain Brook, AL (US); Frederic C. Mayer, Jr., Hoover, AL (US)

(72) Inventors: Gary George Baltz, Jr., Mountain Brook, AL (US); Frederic C. Mayer, Jr., Hoover, AL (US)

(73) Assignee: ALABAMA METAL INDUSTRIES CORPORATION

( * ) Notice: Subject to any disclaimer, the term of this patent is extended or adjusted under 35 U.S.C. 154(b) by 0 days.

(21) Appl. No.: 16/216,253

(22) Filed: Dec. 11, 2018

(65) Prior Publication Data

US 2019/0186147 A1 Jun. 20, 2019

Related U.S. Application Data

(60) Provisional application No. 62/599,864, filed on Dec. 18, 2017.

(51) Int. Cl.

| | |
|---|---|
| ***E04B 1/70*** | (2006.01) |
| ***E04D 13/158*** | (2006.01) |
| ***E04F 19/02*** | (2006.01) |
| ***E04F 19/06*** | (2006.01) |

(52) U.S. Cl.
CPC ..... *E04D 13/158* (2013.01); *E04B 1/70* (2013.01); *E04F 19/02* (2013.01); *E04F 19/061* (2013.01)

(58) Field of Classification Search
CPC ..... E04D 13/158; E04B 1/70; E04F 19/02
See application file for complete search history.

(56) References Cited

U.S. PATENT DOCUMENTS

| | | | |
|---|---|---|---|
| 2,645,824 | A | 7/1953 | Titsworth |
| 3,206,806 | A | 9/1965 | Powell |
| 3,343,323 | A | 9/1967 | Mayfield |

(Continued)

FOREIGN PATENT DOCUMENTS

| | | | |
|---|---|---|---|
| AU | 2008202082 | A1 | 11/2008 |
| CA | 2777166 | A1 | 11/2012 |

(Continued)

OTHER PUBLICATIONS

From application U.S. Appl. No. 15/446,732—cited as "Prior Art Weep Screed from Google Search 1 page: dated 2004".

(Continued)

*Primary Examiner* — Patrick J Maestri
(74) *Attorney, Agent, or Firm* — Jennifer Meredith, Esq.; Lippes Mathias Wexler Friedman LLP

(57) ABSTRACT

A ventilation screed having an upper attachment flange having a top portion and a bottom portion and at least one opening in the top portion; a drip edge protruding from the bottom portion of the upper attachment flange; a drainage cavity protrusion protruding from the bottom portion of the upper attachment flange above the drip edge, wherein the drainage cavity has an L-shaped drainage trough portion having at least one drainage opening in a bottom portion, an upper ground portion in communication with the L-shaped drainage trough portion and a drainage cavity shroud in communication with the upper ground portion, wherein the drainage cavity shroud extends past the drip edge.

16 Claims, 15 Drawing Sheets

(56) References Cited

U.S. PATENT DOCUMENTS

| | | | | |
|---|---|---|---|---|
| 3,568,391 | A | 3/1971 | Conway | |
| 4,924,647 | A | 5/1990 | Drucker | |
| 5,630,297 | A | 5/1997 | Rutherford | |
| 5,694,723 | A | 12/1997 | Parker | |
| 5,809,731 | A | 9/1998 | Reiss | |
| 5,836,135 | A | 11/1998 | Hagan | |
| 6,018,924 | A | 2/2000 | Tamlyn | |
| 6,119,429 | A | 9/2000 | Bifano | |
| 6,293,064 | B1 * | 9/2001 | Larson | E04B 1/762 52/209 |
| 6,298,609 | B1 | 10/2001 | Bifano | |
| 6,308,470 | B1 | 10/2001 | Durkovic | |
| 6,385,932 | B1 | 5/2002 | Melchiori | |
| 6,410,118 | B1 | 6/2002 | Reicherts | |
| 6,470,638 | B1 | 10/2002 | Larson | |
| 6,792,725 | B1 | 9/2004 | Rutherford | |
| 6,823,633 | B2 | 11/2004 | Ryan | |
| 7,219,477 | B2 | 5/2007 | Leffler | |
| 7,546,719 | B1 | 6/2009 | Guevara | |
| 7,584,587 | B2 | 9/2009 | Ouellette | |
| 7,621,079 | B2 | 11/2009 | Kyozaburo | |
| 7,743,575 | B2 | 6/2010 | Ito | |
| 7,810,291 | B2 | 10/2010 | McPherson | |
| 8,281,530 | B2 | 10/2012 | Chaussee | |
| 8,578,660 | B2 * | 11/2013 | Nolan | E04F 19/045 52/302.6 |
| 8,596,019 | B2 | 12/2013 | Aitken | |
| 8,646,222 | B2 | 2/2014 | Carbonaro | |
| D700,717 | S | 3/2014 | Campacci | |
| 8,726,594 | B2 | 5/2014 | Salazar | |
| 8,813,443 | B2 | 8/2014 | Goldberg | |
| 8,919,062 | B1 | 12/2014 | Viness | |
| 8,943,761 | B2 | 2/2015 | Carbonaro | |
| 9,140,008 | B2 | 9/2015 | Fischer | |
| 9,366,040 | B2 | 6/2016 | Singh | |
| 10,060,126 | B2 * | 8/2018 | Collins | E04F 19/02 |
| 2003/0126810 | A1 | 7/2003 | Brunson | |
| 2003/0177736 | A1 | 9/2003 | Gatherum | |
| 2006/0123723 | A1 | 6/2006 | Weir | |
| 2006/0277854 | A1 | 12/2006 | Egan | |
| 2007/0044402 | A1 | 3/2007 | Hess | |
| 2009/0183453 | A1 | 7/2009 | Koessler et al. | |
| 2010/0101168 | A1 | 4/2010 | Hohmann | |
| 2010/0287861 | A1 | 11/2010 | Goldberg | |
| 2011/0252731 | A1 | 10/2011 | Boyer | |
| 2011/0302863 | A1 | 12/2011 | Sourlis | |
| 2012/0066984 | A1 | 3/2012 | Thompson | |
| 2012/0066986 | A1 | 3/2012 | Thompson | |
| 2013/0125487 | A1 | 5/2013 | Power | |
| 2015/0013257 | A1 | 1/2015 | Power | |
| 2015/0027074 | A1 | 1/2015 | Preston | |
| 2017/0030072 | A1 | 2/2017 | Corson | |
| 2017/0226732 | A1 | 8/2017 | Collins | |
| 2017/0254091 | A1 * | 9/2017 | Friel | E04B 1/765 |

FOREIGN PATENT DOCUMENTS

| | | | |
|---|---|---|---|
| JP | 2657037 | B2 | 9/1997 |
| JP | 10037321 | | 2/1998 |
| JP | 11131611 | A | 5/1999 |
| JP | 2008196248 | | 8/2008 |
| JP | 4490340 | B2 | 6/2010 |
| JP | 5968618 | | 8/2010 |
| JP | 2011169094 | A | 9/2011 |
| JP | 5002275 | | 8/2012 |
| JP | 2012202177 | | 10/2012 |
| JP | 2014218814 | | 11/2014 |
| WO | WO2016040273 | | 3/2016 |

OTHER PUBLICATIONS

From application U.S. Appl. No. 15/446,732—cited as "Images of J-Bead believed to have been known in the art prior to Mar. 1, 2016".

* cited by examiner

FLASHING DEVICE ASSEMBLY

TECHNICAL FIELD

The present disclosure generally relates to a device that creates a path for ventilation and drying of exterior walls of buildings and structures from the inside out. The invention can be configured for use with a variety of claddings and finishes; including but not limited to thin veneer stone, manufactured stone, thin brick or three coat stucco finish of cementitious or acrylic material. The device will also start and stop the transition of these materials alone or with other commercial and residential finishes.

BACKGROUND

For purposes of the foregoing specification and appended claims the terms "air" and "water," "moisture" or "vapor" whether or not accompanied by any words such as "vapor," "gas," "liquid," "moisture, "water" or other words describing similar matter or states of matter, refers to all forms of liquids and gases not limited to water, water vapor, and moisture as created by any means.

The juncture of dissimilar materials is and has been an ongoing problem in the science and building practices associated with the exterior walls of buildings and structures. Creating a functional and aesthetic juncture frequently inhibits the escape of vapor or water since the termination of one material above and a different material below frequently ends up creating a dam blocking the escape of such vapor or water.

Walls hold moisture and their inability to allow moisture to escape and the wall to dry can be a major factor in the premature deterioration of a structure. Building science, construction practices and evolving energy codes have changed greatly over the recent decades resulting in significantly better insulated walls. However these newer wall designs signs allow less means for water to escape and less air flow leading to increasingly premature deterioration of walls of buildings and structures.

Established wall designs and construction are intended to keep water out of walls but not necessarily to allow them to breathe. Building wraps traditionally prevent water intrusion but do not necessarily let sufficient moisture out. A better wall design must allow for moisture and vapor to move through a predetermined path depending upon when the inside and outside temperatures have the sufficient temperature difference to create and hold excess moisture.

Further, air pressure differential from inside and outside the wall due to temperature and or wind can force moisture into the wall through the wall's surface, in addition to preventing vapor and moisture from escaping. This prevents condensation from escaping and inhibits drying. Further, when cold air contacts hot air, or vice versa, condensation occurs and moisture is formed inside the walls of buildings and structures.

As a result, moisture and water accumulates without a means to escape causing the sheathing of walls to absorb moisture. Plywood, cement board, or OSB (Oriented Strand Board), which is more prone to absorb moisture, can begin to mold, deteriorate, rot and hold more water. As the sheathing fails the weight of the finish material will begin to crack. This allows more moisture accumulation in the walls. Ultimately the finish material can fall away from the building or structure. Areas receiving 20-inches or more of rain a year are the most susceptible to this type of deterioration.

The juncture of dissimilar materials always presents a problem with the movement and escape of vapor from a wall of any construction material(s) and any construction practice(s). The embodiments disclosed herein address this problem and directly relate to cladding materials terminating horizontally above manufactured stone. Preventing the damming of water at the juncture and securing a sill stone while still allowing the entire wall to ventilate, vapor to escape and the wall to dry is a problem that leads to deterioration, and ultimate failure of the cladding.

Current commercially available accessories for stucco, stone and other finishes do not address these conditions and constraints on air and vapor flow within a wall. Therefore a new wall design and trim accessories are necessary to accommodate the different forms and function of the building envelope.

SUMMARY OF THE INVENTION

According to one aspect of the present invention, a flashing device assembly is provided, the device assembly comprising: an upper flashing portion having a first flange with an upper edge and a lower edge; a second flange having an attached side and a drip edge; a flexible joint attached to the first flange and the second flange between the lower edge of the first flange and the attached side of the second flange; and a flexible moisture stop that extends from a bottom surface of the second flange and is a curved lip that curves away from the first flange. There may also be, among other things and without limitation, a lower sill ledge, primary drainage plains, insect screens and a starter strip.

BRIEF DESCRIPTION OF THE DRAWINGS

In the following section, the present disclosure will be described with reference to exemplary embodiments illustrated in the figures, in which.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other. It is noted that various figures (including component diagrams) shown and discussed herein are for illustrative purpose only, and are not drawn to scale.

One embodiment defines a one piece device that provides an unlimited number of degrees of slope so that moisture in whatever form, will follow the surface of the device, and will be directed out and away from a building's walls and provide for moisture to escape a building's exterior wall at the juncture of dissimilar materials. Another embodiment defines a one piece device that provides a shelf for building materials to rest on and provides for moisture to escape a building's exterior wall. This device permits the escape of vapor from just below the sill stone. This second embodiment defines a base ledge or starter strip for manufactured stone. Another embodiment of the device allows a starter strip for manufactured stone finishes at the base of a wall of a building or structure.

Figure 1:
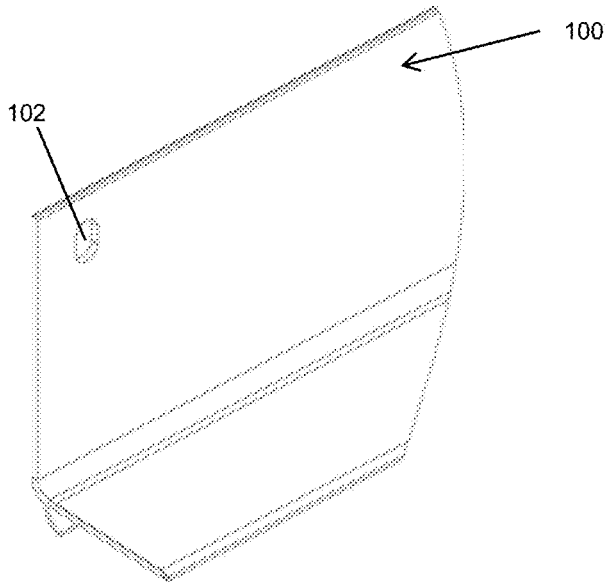
FIG. 1 depicts an isometric view of the present invention.
Figure 2:
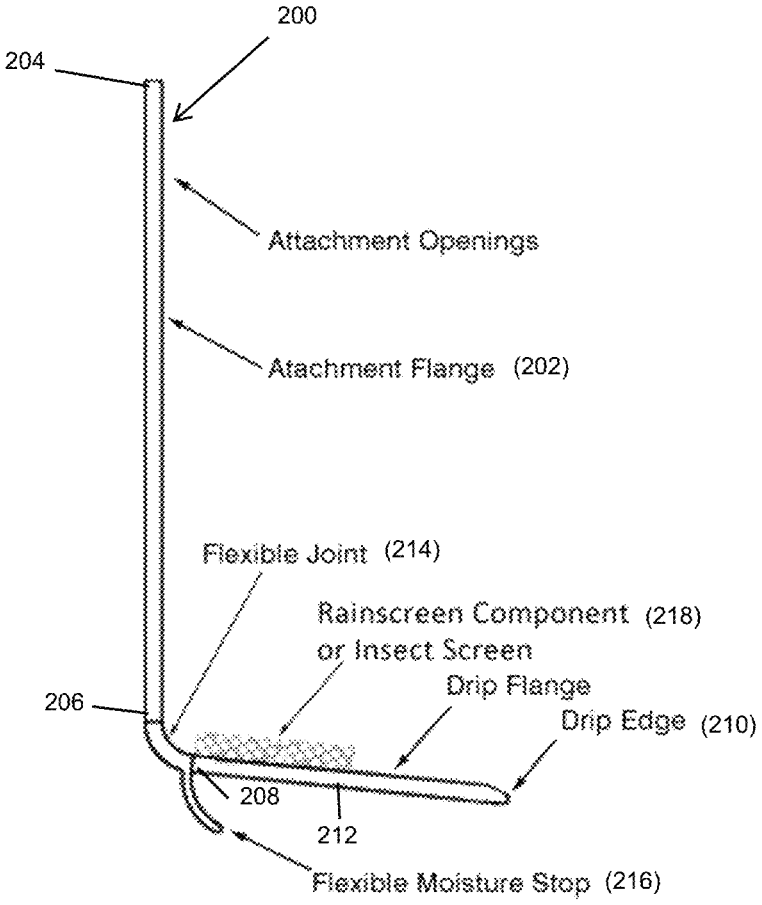
FIG. 2 depicts a side view of the present invention with labeling.
Figure 3:
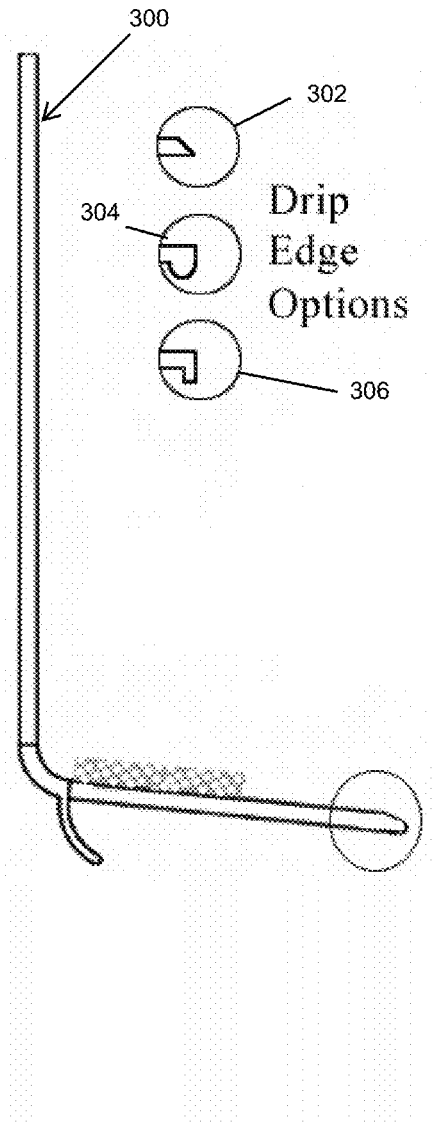
FIG. 3 depicts a side view of the present invention without labels and depicting various drip edge options.

The present invention is susceptible to many different forms. There is shown in the drawings, and herein is described in detail, several preferred embodiments with the understanding that the present descriptions are to be considered an exemplification of the principles of the invention and are not intended in any way to limit the invention to that as illustrated and described herein. Existing stucco, manufactured stone and continuous insulation installation accessories (profiles) do not allow for air movement (drying) and vapor or moisture escape from the building envelope. In addition, the flanges of the various embodiments of this device can be composed of a rust-resistant metallic substance, coupled with a flexible joint composed of a non-metallic material such as, but not limited to plastic, vinyl, acrylic or polymer manufactured as a single component at the factory. FIG. 1 an isometric depicts an embodiment of this device that blocks the intrusion of power driven water or windblown rain. Any exterior cladding and construction practice requires flashing the juncture of dissimilar materials. Since flashing is work not supplied and performed by any one trade, the incorporation of a flashing bead by the cladding finish mechanic somewhat ensures the work is done and done properly. FIG. 2 depicts various embodiments of this invention and other components that can be fabricated from a plurality of materials to take into consideration the specific requirements of different building envelope systems, construction practices and weather conditions. The embodiments of this invention depicted in FIG. 2 can be polymer non-metallic materials, resistant to rusting and deterioration in moisture and salt or caustic environments, but also can be composed of stainless steel materials, galvanized metal materials, metal alloy materials or composite materials. FIG. 2 depicts an embodiment, comprising a flexible moisture stop, of this device that also blocks the intrusion of power driven water or windblown rain. FIG. 2 depicts an embodiment with two (2) flanges, an attachment flange and a drip flange, with a plurality of lengths to accommodate different conditions and a flexible joint to achieve an unlimited degree of slope. A further embodiment of the device is a flexible moisture stop that provides a block to water being forced by wind or pressure. The leading edge of the trim bead has an optional tapered edge or plane to further provide a drip edge for condensed vapor. This embodiment can be fitted with an architectural shape or feature that can enhance the moisture management system further to fit any style of home or construction. FIG. 2 depicts an embodiment of the present invention manufactured or modified on site to include a screen or mesh to act as a conduit to facilitate the escape of vapor moving through the primary drainage plane, (rainscreen or solid or corrugated furring strips). The embodiment of the present invention may be manufactured or modified on site to include screen or mesh to block insect infestation. FIG. 3 depicts embodiments illustrating various drip edge options.

Figure 4:
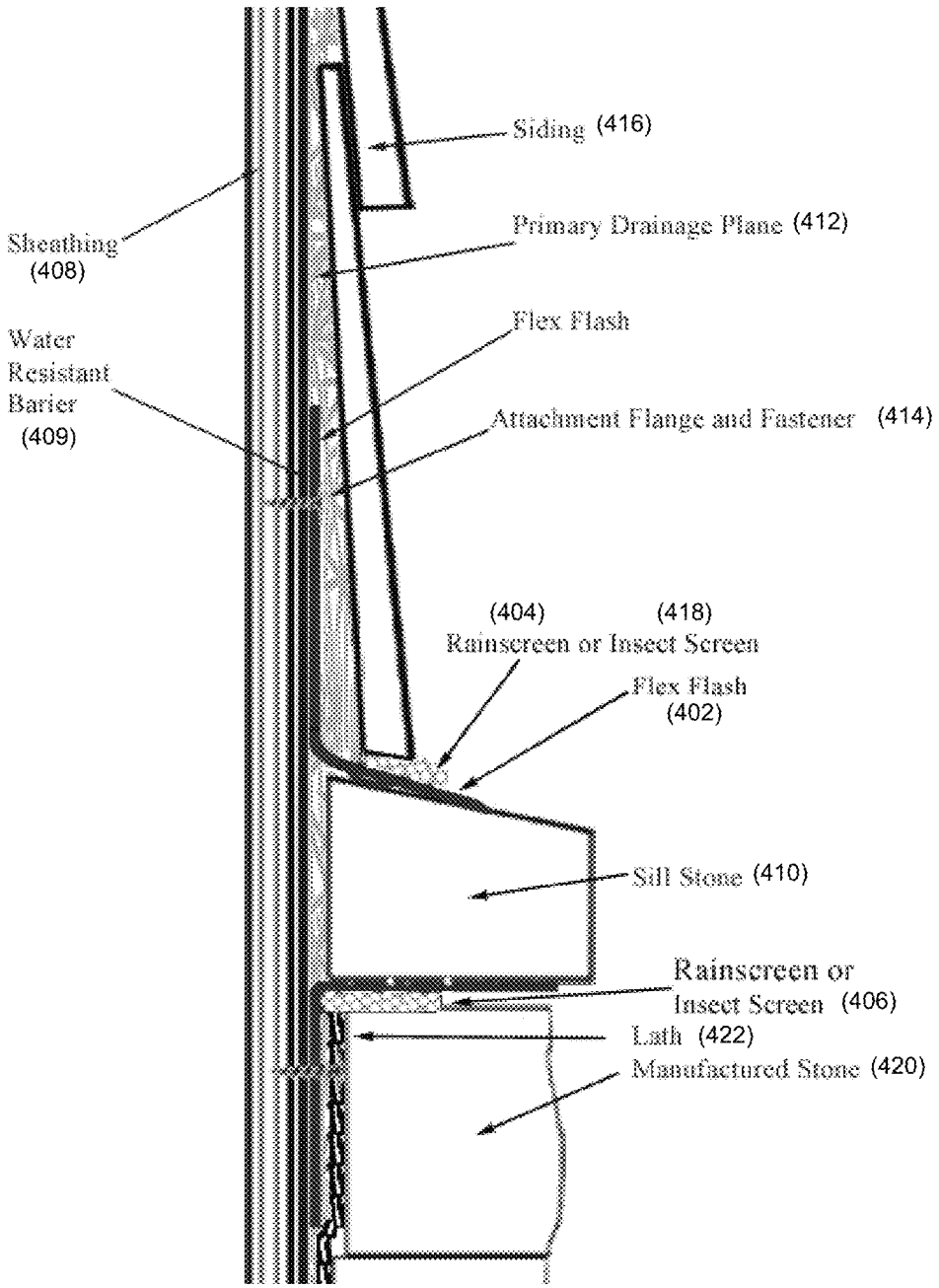
FIG. 4 depicts a side view of the present invention shown with labels depicting a wall section with flash and sill ledge.
Figure 5:
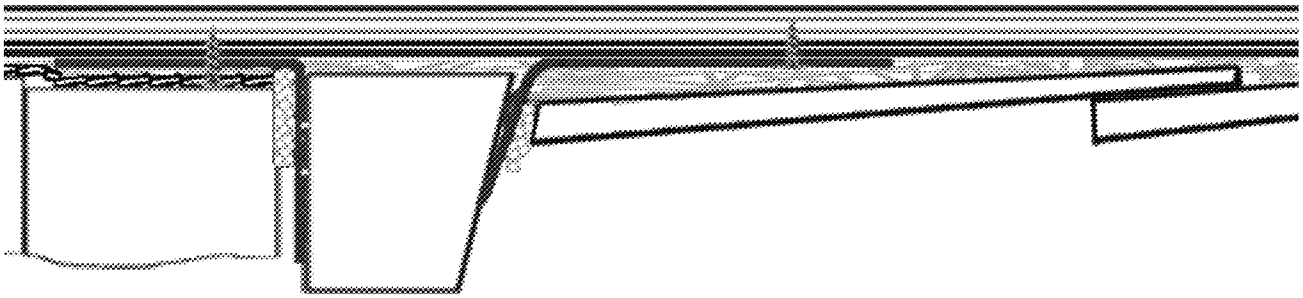
FIG. 5 depicts the same view of FIG. 4 without labels for unobstructed clarity of the present invention.
Figure 6:
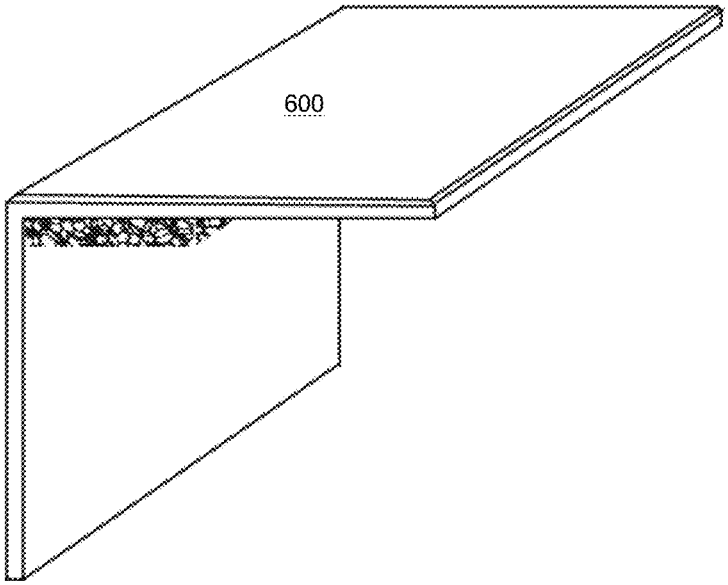
FIG. 6 depicts an isometric view of a sill ledge according to the present invention.

FIGS. 4 and 5 depict embodiments that can be used individually or in combination to allow varying levels of vapor escape and drying depending upon but not limited to the amount of rainfall, wind speeds, seismic activity, temperature variations, icing, interior and exterior air pressure and the design of the building or structure. FIGS. 4 and 5 each depicts an embodiment for ventilation of the wall incorporating both the Flashing and Sill Stone Ledge with siding and manufactured stone. FIGS. 4, 5, 15, 16, 17 and 18 depict embodiments to allow ventilation of walls and permit air flow with or without a mechanical fan or similar device to aid in evaporation, drying and vapor release from the wall. These figures depict embodiments that define a drainage plane that can be created using a non-metallic, non-organic, anti-microbial rainscreen or solid or corrugated furring strips that will not degrade, rot or oxidize within the wall cavity.

Wall designs and construction practices may or may not incorporate rainscreen or solid or corrugated furring strips.

Figure 19:
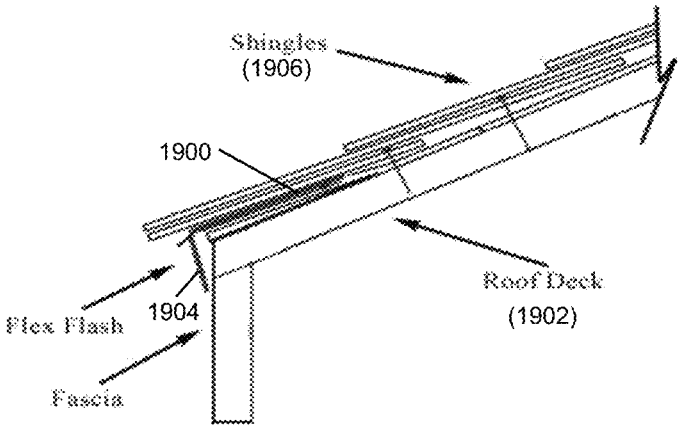
FIG. 19 depicts the present invention installed as a roof cap drip edge with labels.
Figure 20:
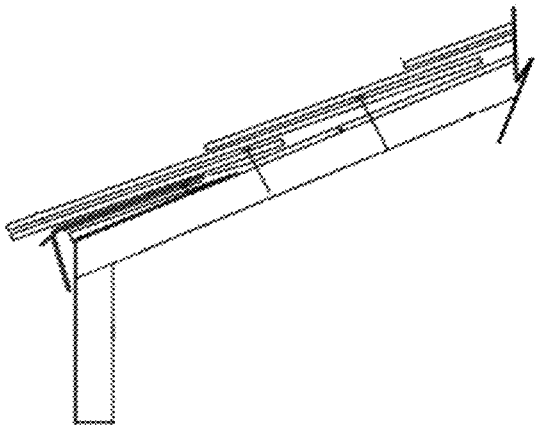
FIG. 20 depicts the present invention, as in FIG. 19, installed as a roof cap drip edge without labels.

FIGS. 1-20 depict embodiments of this device that can be used with new construction or the remediation of deteriorated or deficient walls of stucco, manufactured stone, exterior finish insulation systems or continuous insulation. FIGS. 19 and 20 depict an embodiment that can be utilized as roof edge flashing. In another embodiment, the device provides a drainage shelf to divert water away from the foundation of a building or structure. Another embodiment of the device can also be used at joints of dissimilar materials such as, but not limited to, use with siding over veneer stone, stucco over veneer stone, metal panels, rigid insulation to prevent the intrusion of moisture and a means for the escape of vapor. FIGS. 4 and 5 depicts an embodiment that addresses the unique needs and considerations of framed/sheathed walls, masonry and concrete masonry units and assemblies that can incorporate exterior cement based or acrylic synthetic stucco over a lathing substrate, manufactured stone over lathing substrate, various thicknesses of continuous thermal exterior insulation, wood or man-made siding, and metal panels both with and without insulation. Although this embodiment is useful with any type of cladding, a common finish it can be used with is manufactured stone and veneer brick. The weight of a sill stone is several pounds per lineal foot. When a sill stone is installed adequate support to hold and fix the sill in place is needed. This device allows for the weight of the stone to be installed and assists in securing the stone in place while promoting ventilation and drying of the wall.

Figure 7:
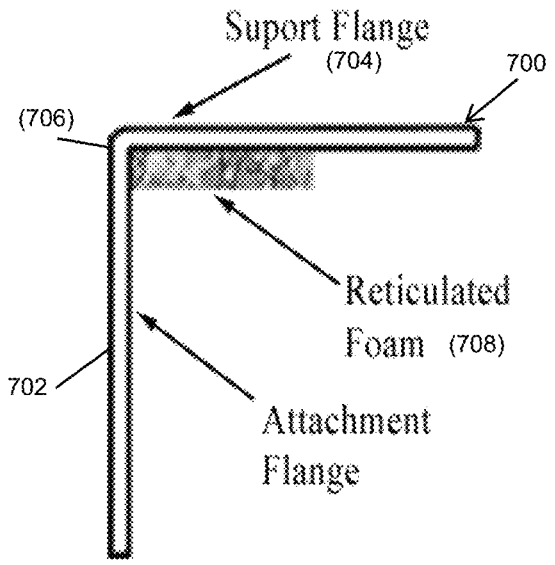
FIG. 7 depicts a side view of a sill ledge with labels according to the present invention.
Figure 8:
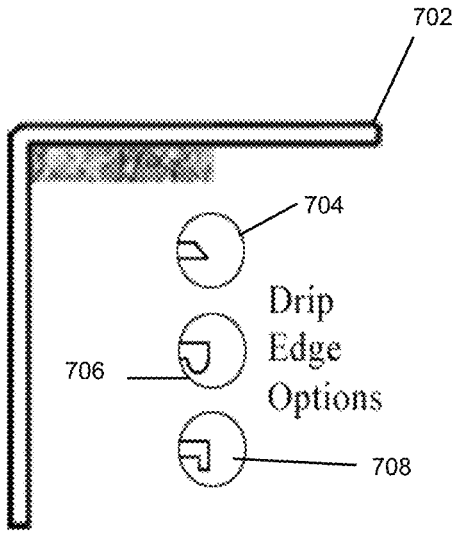
FIG. 8 depicts a side view of a sill ledge, as in FIG. 7, without labels for unobstructed clarity of the present invention and depicting additional drip edge options.
Figure 9:
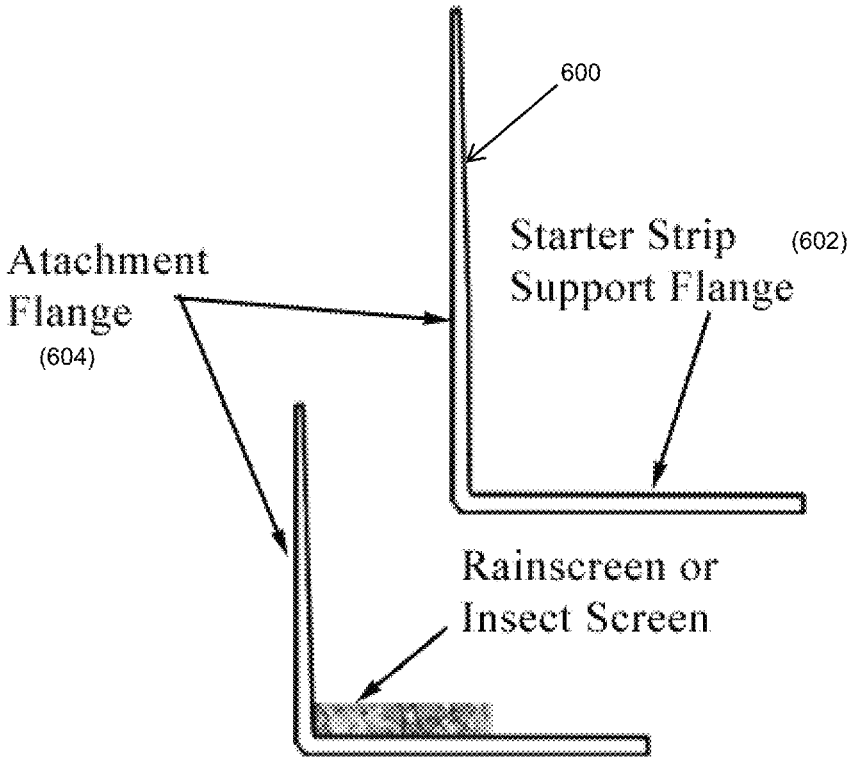
FIG. 9 depicts a side view of an embodiment including a starter strip support flange according to the present invention with labels.
Figure 10:
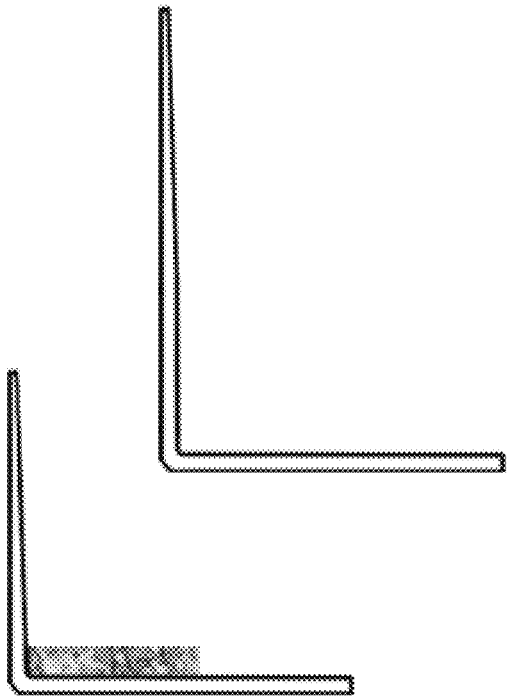
FIG. 10 depicts a side view of the embodiment depicted in FIG. 9 without labels for unobstructed clarity of the present invention.

FIGS. 7 and 8 depicts an embodiment with optional reticulated foam insert acting as an insect screen while allowing vapor to escape the wall. FIGS. 7 and 8 depict an embodiment where the device has squared ends and options for a plurality of shapes and sizes for drip edges. FIG. 7 depicts the movement and escape of vapor through the wall using a reticulated foam. This may also be rainscreen or solid or corrugated furring strips or an insect screen. FIGS. 9 and 10 depicts another embodiment wherein the device is rotated vertically 180-degrees to function as a starter strip for manufactured stone. The flanges of this device can vary in length and thickness. Flanges can be equal in length or of varying lengths to accommodate different stone dimensions and styles. The attachment holes can be in either the first or the second flange of the device, depending upon its orientation of installation and function in the wall. An embodiment of this device has a plurality of openings in the portion of the flange between the first stone course and the attachment flange. An embodiment of this device has reticulated foam covering holes (see above) allowing vapor in any form to escape as well as blocking holes from insect intrusion.

With reference to FIGS. 1-20, the present invention provides a flashing device assembly. A portion of the device assembly may be seen in FIGS. 1, 2 and 3, as an upper flashing portion (100, 200 and 300). As depicted in FIG. 1, there may be at least one attachment opening (102) which is used to attachment the upper flashing portion (100, 200 and 300) to a portion of a building structure. The upper flashing portion may be installed vertically on an outer portion of a house (as depicted in FIGS. 15, 16, 17 and 18) or it may be installed at a roof angle (as depicted in FIGS. 19 and 20). The upper flashing portion (200) comprising a first flange (202) an upper edge (204) and a lower edge (206); a second flange (212) having an attached side (208) and a drip edge (210); a flexible joint (214) attached to the first flange (202) and the second flange (212) between the lower edge (206) of the first flange (202) and the attached side (208) of the second flange (212); and a flexible moisture stop (216) that extends from a bottom surface of the second flange (212) and is a curved lip that curves away from the first flange. As can be seen, the flexible moisture stop (216) may be a curved lip that is approximately ten to twenty percent of a circle. The flexible joint (214) has between a 355 and 360 degree range of movement. In this way, it flexes to accommodate many different environments and implementations. The second flange (212) rests at an angle between 90 and 120 degrees from the first flange. This is to say that while the flexible joint flexes to accommodate a range of movement, it is at an angle of 90 and 120 degrees when not flexed. This is critical because it allows for downward direction of any water away from the building. The drip edge may be a sharp angled edge (302), a rounded rectangular edge (304) or a rectangular edge (306). The particular sharp angled edge (302) may be useful to provide a drip edge for condensed vapor. The particular edge chosen would impact the water flow and would be useful according to whether the water flowing would be more vapor or solid form water. There may also be a screen (218) on a top surface of the second flange. The screen (218) may be a rainscreen or solid or corrugated furring strips or an insect screen depending on the environment the assembly is to be used in.

The flashing device assembly may also have a sill ledge (400) (as depicted in FIGS. 4, 5, 6, 7 and 8) which is installed below the upper flashing portion (402). The sill ledge (600, 700) having an attachment flange (702) and a support flange (704), wherein the support flange (704) is attached to a top portion (706) of the attachment flange (702) at an angle between 80 and 100 degrees. The embodiment depicted is at an angle of 90 degrees or a right angle. The support flange (700) may also have a support flange drip edge (702). The support flange drip edge (702) may be a sharp angled edge (704), a rounded rectangular edge (706) or a rectangular edge (708). There may be a reticulated foam insert (708) on a bottom side of the support flange (704).

The insect screen (404, 406) could be reticulated foam, it could be an unwoven polymer such as cellulose, nylon or spun polypropylene fiber, or it could be even a nylon or polypropylene screen, although that would be less durable. The screen may be a "GreenScreen™", or another rain screen or solid or corrugated furring strips. The term "GreenScreen™" refers to a polypropylene entangled mesh, but it could also be described as a polymer strand matrix with a dimple structure. The GreenScreen™ rainscreen provides a drainage path and ventilation for moisture between the exterior wall finish and sheathing. It is a polypropylene mesh or polymer strand matrix with a unique dimple design that exhibits superior compressive strength. When installed according to the present invention it allows over 99% of moisture and vapor to drain and escape from the wall. FIGS. 4-5 depict an embodiment with flashing and a sill ledge (400). There is the sheathing (408), a water resistant barrier (409) covering the sheathing (408). The upper flashing portion (402) (also referred to as Flex Flash™) sits on a sill stone (410) and the first flange is parallel to and in communication with the water resistant barrier (409). There may be a fastener (414) which may be, for example, a screw, that secures the upper flashing portion (402) to the sheathing (408). A primary drainage plane (412) covers the first flange of the upper flashing portion. The siding (416) covers the primary drainage plane (412). There may be a screen (418) that is between the second flange of the upper flashing portion (402) and the bottom of the siding (416). The sill ledge (400) is under the sill stone (410) and may have lath (422) attached to the attachment flange portion of the sill ledge and a screen under the support flange portion of the sill ledge. The screen (406) may be between the support flange portion of the sill ledge and the manufactured stone (420).

Figure 11:
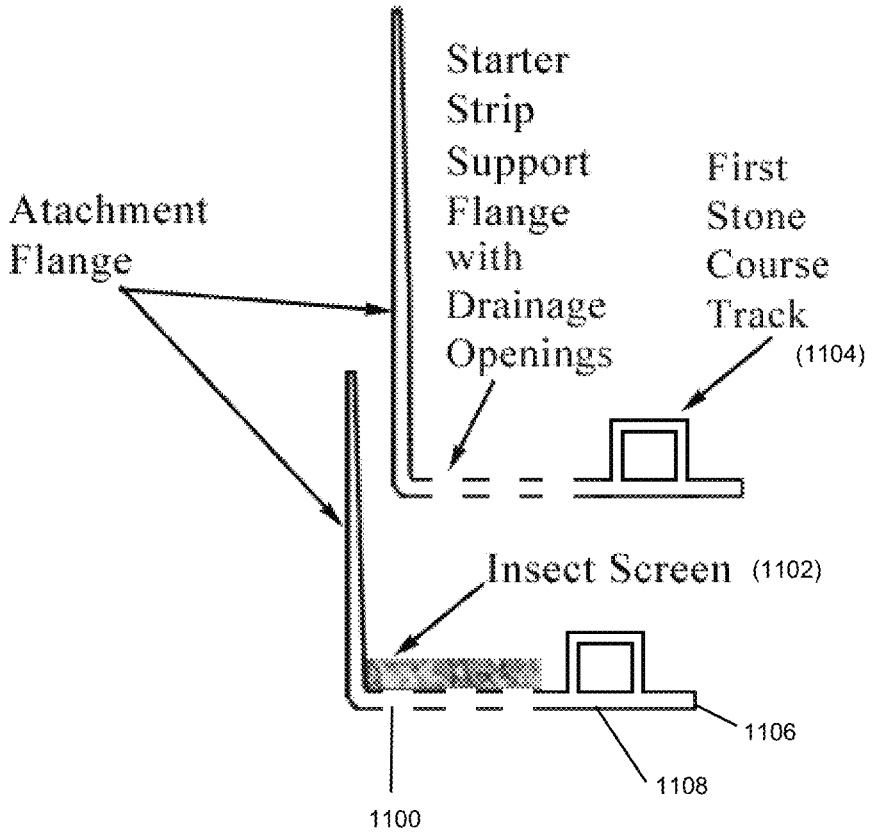
FIG. 11 depicts a side view of an embodiment including a stone starter strip support flange according to the present invention with labels.
Figure 12:
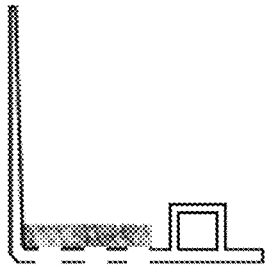
FIG. 12 depicts a side view of the embodiment depicted in FIG. 11 without labels for unobstructed clarity of the present invention.
Figure 13:
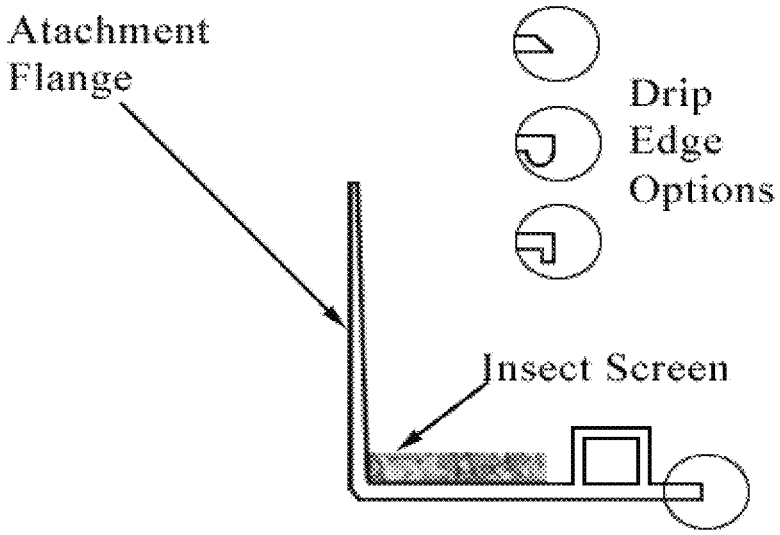
FIG. 13 depicts a side view of a starter track drip edge with labels.
Figure 14:
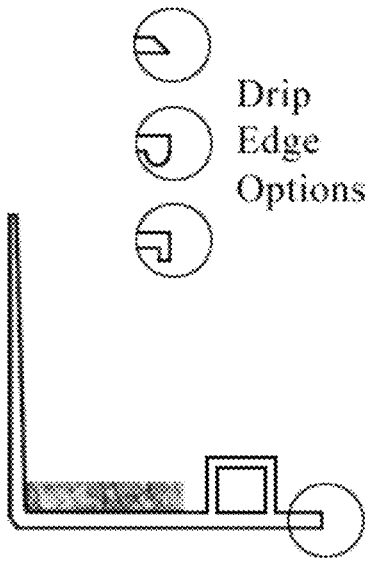
FIG. 14 depicts a side view of a starter track drip edge, as in FIG. 13, without labels for unobstructed clarity of the present invention.
Figure 15:
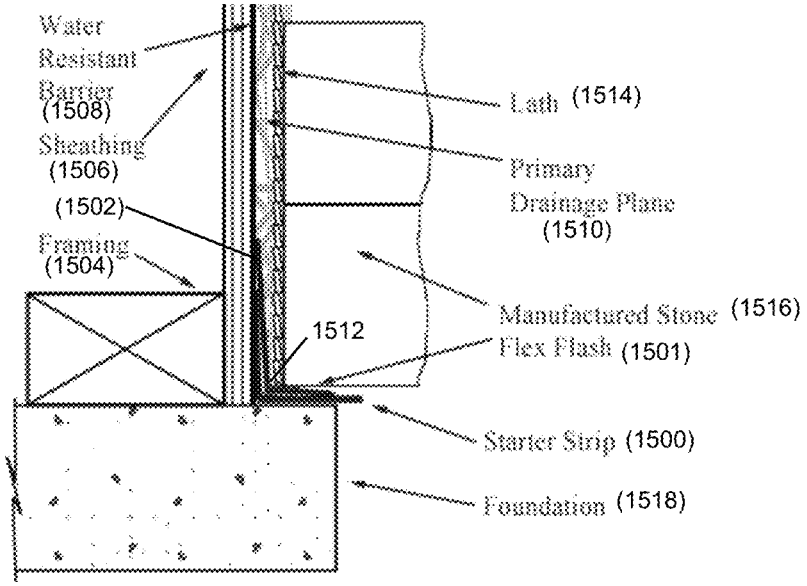
FIG. 15 depicts the present invention installed at the base of a stone wall according to the present invention.
Figure 16:
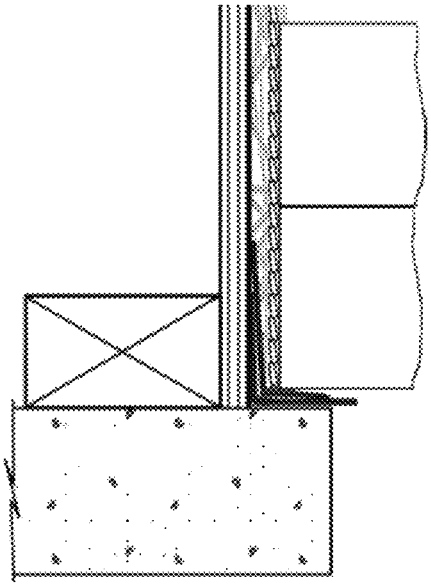
FIG. 16 depicts the present invention, as in FIG. 15, without labels for unobstructed clarity of the present invention.
Figure 17:
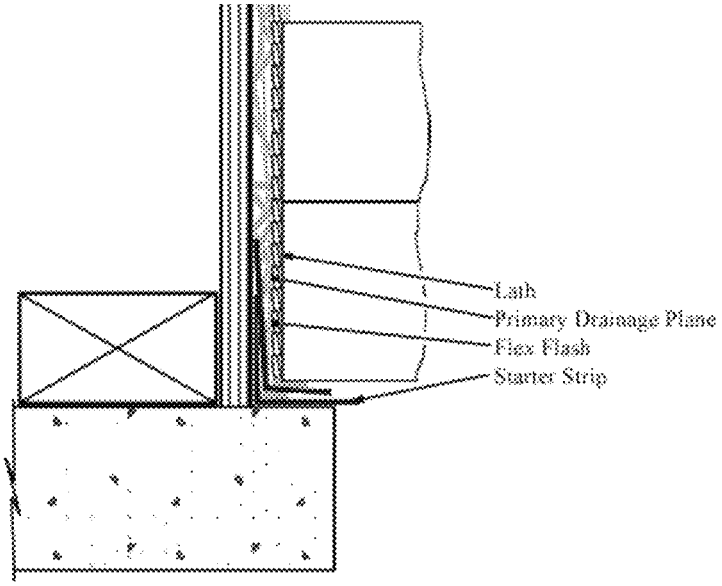
FIG. 17 depicts the present invention installed at the base of a wall with labels according to the present invention.
Figure 18:
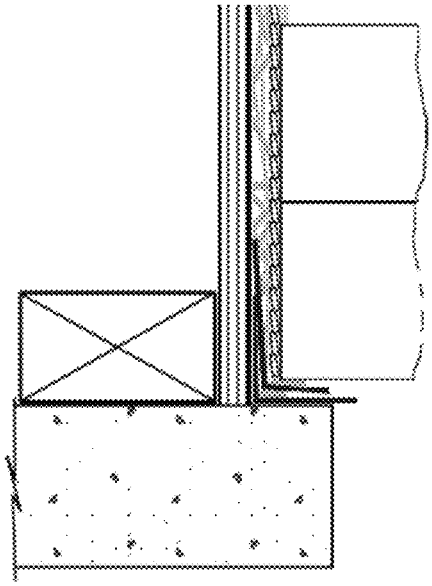
FIG. 18 depicts the present invention, as in FIG. 17, installed at the base of a wall without labels.

In the assembled device, there may be a starter strip (600) having a starter strip support flange (602) and a starter strip attachment flange (604), wherein the starter strip support flange (602) is attached to the starter strip attachment flange (604) at an angle between 80 and 100 degrees. As depicted, the starter strip attachment flange is at a right angle or 90 degrees to the starter strip support flange. As shown in FIGS. 11 and 12, the starter strip support flange has at least one drainage opening (1100). There may also be a screen (1102) on a top surface of the starter strip support flange that covers the drainage openings. There may also be a first stone course track (1104) which protrudes upward from the starter strip support flange (1108) at a distance away from a far end (1106) of the starter strip support flange (1108). The first stone course track (1104) may be a raised hollow square shape that extends the length of the starter strip support flange (1108). The first course stone track allows moisture to escape. Any holes can be covered with reticulated foam or a screen to prevent insect intrusion.

There are many different ways the present invention may be installed. The first flange (1502) of the flashing device assembly (1501) may be installed substantially parallel to and in communication with a vertical wall surface (1504). There may be a starter strip (1500). FIG. 9 depicts the starter strip support flange (602) and a starter strip attachment flange (604), wherein the starter strip support flange is attached to the starter strip attachment flange at an angle between 80 and 100 degrees. There may be sheathing (1506) which may be considered a vertical wall surface. Exterior wall sheathing strengthens the wall system, provides a nailing base for the siding, and gives a layer of protection against outside elements. Structural sheathing gives a home or commercial building integrity and rigidity. It provides a surface for the application of materials, like siding, and helps shield a structure from rain, snow, wind, etc. Four examples of structural exterior sheathing options include wood-based, gypsum, glass mat and cement board. There may be a water resistant barrier (1508) on top of the sheathing (1506). The first flange (1502) may be parallel to the sheathing (1506) vertical wall surface. A primary drainage plane (1510) having a bottom end (1512) that sits in the flexible joint and covers the upper edge of the first flange (1502). There may be lath (1514) that covers the primary drainage plane (1510) and manufactured stone (1516) that covers the lath (1514). FIGS. 15, 16, 17 and 18 depict the flashing device assembly at the base of a stone wall above the foundation (1518). FIGS. 19 and 20 depict the flashing device assembly as a roof cap drip edge. As can be seen, the first flange (1900) is installed substantially parallel to and in communication with a roof deck (1902) and the second flange (1904) overhangs a downslope end of the roof deck (1902). The shingles (1906) are installed above the first flange (1900).

As the invention has been described, it will be apparent to those skilled in the art that the same may be varied in many ways without departing from the spirit and scope of the invention. Any and all such modifications are intended to be included within the scope of the appended claims.

In the preceding description, for purposes of explanation and not limitation, specific details are set forth (such as particular structures, components, techniques, etc.) in order to provide a thorough understanding of the disclosed wall ventilation system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

Figure 21:
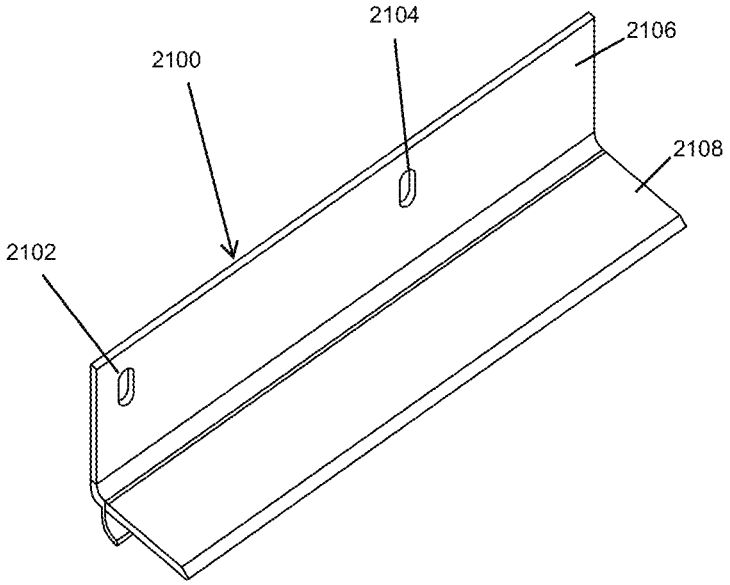
FIG. 21 depicts the present invention.

FIG. 21 depicts a flashing device according to the present invention. The upper flashing portion (2100) has a first flange (2106) with at least one attachment opening (2102 and 2104). The attachment openings are spaced every six inches and the first flange (2106) is two inches and the second flange (2108) is two inches. The upper flashing portion (2100) can run any desired length with the attachment openings (2102 and 2104) every six inches. The dimensions are according to a preferred embodiment, but are not required to be exact.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A flashing device assembly, the device assembly comprising:

an upper flashing portion having:

a first flange an upper edge and a lower edge;

a second flange having an attached side and a drip edge;

a flexible joint attached to the first flange and the second flange between the lower edge of the first flange and the attached side of the second flange; and a flexible moisture stop that extends from a bottom surface of the flexible joint and is a curved lip that curves away from the first flange; and a starter strip having a starter strip support flange and a starter strip attachment flange, wherein the starter strip support flange is attached to the starter strip attachment flange at an angle between 80 and 100 degrees.

2. A flashing device assembly as in claim 1, wherein the flexible joint has between a 355 and 360 degree range of movement.

3. A flashing device assembly as in claim 1, wherein the second flange rests at an angle between 90 and 120 degrees from the first flange.

4. A flashing device assembly as in claim 1, wherein the drip edge is a sharp angled edge, a rounded rectangular edge or a rectangular edge.

5. A flashing device assembly as in claim 1, further comprising an screen on a top surface of the second flange.

6. A flashing device assembly, the device assembly comprising:

an upper flashing portion having:

a first flange an upper edge and a lower edge;

a second flange having an attached side and a drip edge;

a flexible joint attached to the first flange and the second flange between the lower edge of the first flange and the attached side of the second flange; and a flexible moisture stop that extends from a bottom surface of the second flange and is a curved lip that curves away from the first flange; and a sill ledge having an attachment flange and a support flange, wherein the support flange is attached to a top portion of the attachment flange at an angle between 80 and 100 degrees.

7. A flashing device assembly as in claim 6, wherein the support flange has a support flange drip edge.

8. A flashing device assembly as in claim 7, wherein the support flange drip edge is a sharp angled edge, a rounded rectangular edge or a rectangular edge.

9. A flashing device assembly as in claim 6, further comprising a reticulated foam insert on a bottom side of the support flange.

10. A flashing device assembly as in claim 1, wherein the starter strip support flange has at least one drainage opening.

11. A flashing device assembly as in claim 1, wherein the starter strip support flange has a first stone course track which protrudes upward from the starter strip support flange at a distance away from a far end of the starter strip support flange.

12. A flashing device assembly as in claim 1, further comprising an insect screen on a top surface of the starter strip support flange.

13. A flashing device assembly as in claim 1, wherein the first flange is installed substantially parallel to and in communication with a vertical wall surface.

14. A flashing device assembly as in claim 1, wherein the first flange is installed substantially parallel to and in communication with a roof deck and the second flange overhangs a downslope end of the roof deck.

15. A flashing device assembly as in claim 1, wherein the first flange has at least one attachment opening.

16. A flashing device assembly as in claim 1, further comprising a primary drainage plane having a bottom end that sits in the flexible joint and covers the upper edge of the first flange.

* * * * *